United States Patent [19]

Weiss et al.

[11] Patent Number: 4,793,567

[45] Date of Patent: Dec. 27, 1988

[54] CLAMPING HEAD FOR CENTERING AND CLAMPING WINDING TUBES

[75] Inventors: Hans Weiss; Hans-Joachim Fissmann; Hans-Albrecht Ruff, all of Heidenheim, Fed. Rep. of Germany

[73] Assignee: J. M. Voith GmbH, Heidenheim, Fed. Rep. of Germany

[21] Appl. No.: 108,228

[22] Filed: Oct. 14, 1987

[30] Foreign Application Priority Data

Oct. 25, 1986 [DE] Fed. Rep. of Germany ..... 3636457

[51] Int. Cl.[4] ..... B65H 18/04; B65H 16/06

[52] U.S. Cl. ..... 242/68.1; 242/68.4

[58] Field of Search ..... 242/68.1–68.6, 242/129.51

[56] References Cited

U.S. PATENT DOCUMENTS

| | | | |
|---|---|---|---|
| 2,928,619 | 3/1960 | Burton et al. | 242/68.1 |
| 3,955,770 | 5/1976 | Offermann | 242/68.4 |

FOREIGN PATENT DOCUMENTS

| | | |
|---|---|---|
| 1676507 | 5/1954 | Fed. Rep. of Germany . |
| 1574438 | 7/1970 | Fed. Rep. of Germany . |
| 2222291 | 11/1973 | Fed. Rep. of Germany . |
| 2832361 | 1/1980 | Fed. Rep. of Germany . |
| 3243994 | 5/1984 | Fed. Rep. of Germany . |
| 377854 | 7/1964 | Switzerland . |
| 400708 | 4/1966 | Switzerland . |
| 888860 | 2/1962 | United Kingdom . |

*Primary Examiner*—Stuart S. Levy
*Assistant Examiner*—Steven M. duBois
*Attorney, Agent, or Firm*—Lon H. Romanski

[57] ABSTRACT

A clamping head is shown having a cylindrical portion engaging an interior portion of an associated winding tube and a collar or flange which axially abuts against the axial end face of the associated winding tube; extending axially between the cylindrical portion and the collar or flange is a conical portion of longitudinally extending serration; the teeth of such serration start, from the diameter of the cylindrical portion, beginning with a zero cross-section and increase toward the collar or flange with steadily increasing geometrically similar cross-section.

8 Claims, 1 Drawing Sheet

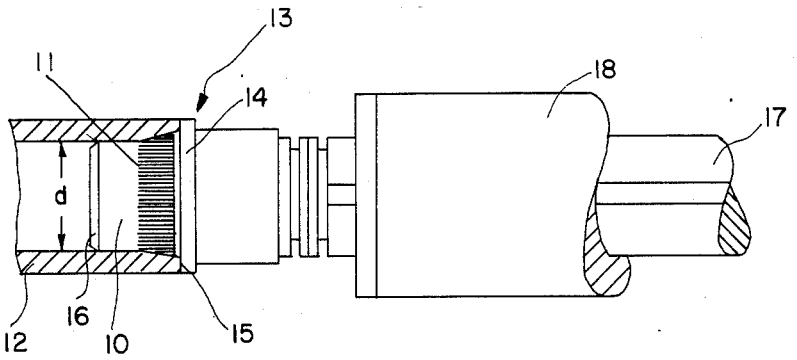
Fig. 1
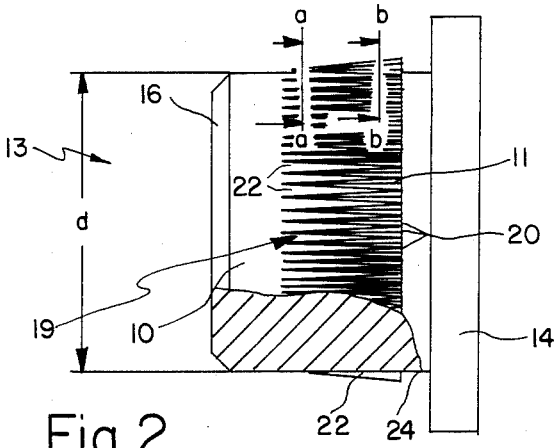
Fig. 2
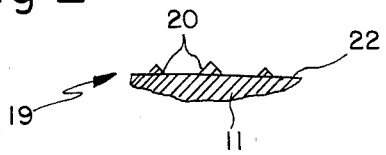
Fig. 2a
Fig. 2b
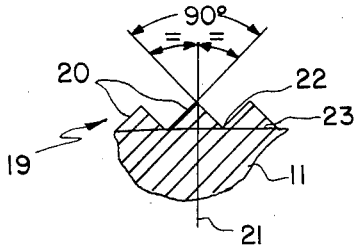

CLAMPING HEAD FOR CENTERING AND CLAMPING WINDING TUBES

FIELD OF THE INVENTION

This invention relates generally to rotary clamping heads and more particularly to clamping heads for centering and clamping winding tubes onto which web type material, such as for example paper webs and the like, is being wound.

BACKGROUND OF THE INVENTION

Clamping heads, generally, have been known in the prior art. For example, Federal Republic of Germany patent document No. 1,574,438 illustrates a clamping head as being a relatively long generally cylindrical assembly formed of a plurality of relatively long arcuate-like pipe-like segments. In transverse cross-section, as in FIG. 2 of said patent document, the outer-most periphery of each of such segments lies in what may be considered a cylindrical configuration and forms a sector thereof. The circumference or outer periphery of each of such segments is provided with a longitudinally extending serration. Except for a very short bevel which facilitates the introduction of the clamping head into the winding tube 11, the teeth of the serration have a constant cross-section extending for the full length thereof between the free end of the clamping head and the associated collar 31 (FIG. 1 of said patent document). Upon expansion of the cylindrical assembly, after its introduction or insertion into the winding tube, the arcuate or cylindrical segments are pressed or forced against the inner cylindrical surface of the core or winding tube. Consequently, the winding tube, of said patent document, is supported only by the tips of the teeth comprising the serration. Further, if any penetration into the body of the winding tube by such outer tips of the teeth occurs, neither the depth nor uniformity of such penetration is in any way controlled or gauged and therefore the axis of the winding tube becomes misaligned to the axis of rotation of the clamping head. Such a disclosed clamping head cannot fulfill the operating requirements that exist in connection with modern winding machines as for example disclosed in Federal Republic of Germany Letters Patent No. 3,243,994.

Presently, in order to be acceptable, the structural length of the clamping head used at the ends of the winding tubes must be short so that the axial movement of the clamping head, for introduction into and extraction from the winding tube, will also be short. Such short movement, of course, is an important factor in the overall time required for changing as from a full to an empty winding tube as well as in determining the maximum width or axial length of the winding tube which may be employed in a particular machine. Further, the clamping head must be able to support the relatively great weight of the roll being formed on the winding tube without destruction of the winding tube when, for example, to influence or control the winding harness, the line pressure of the wound roll on the roll-carrying cylinders of the machine is reduced. For acceptable products, there must be no deflection of the roll to be wound. Also, for proper operation, there can be no relative rotation as between the clamping head and the winding tube especially if the length of material wound onto or off the winding tube is to be determined, as by related automatic sensing means directly or indirectly sensing the rotation and revolutions of the clamping head. In such arrangements, the assured rotation of the clamping head in unison with the winding tube is indispensible for the exact determination of the length of the web material to be wound or unwound as well as for controlling the winding hardness of the web material.

The invention as herein disclosed is primarily directed to overcoming the aforestated problems of the prior art and to providing a clamping head having the desired characteristics and features as hereinbefore set forth.

SUMMARY OF THE INVENTION

According to the invention, a clamping head for centering and clamping a winding tube onto or from which web type material such as a paper web and the like is being wound or unwound and wherein said winding tube comprises an internal axially extending cylindrical surface, comprises a clamping head body means, said body means comprising a non-expandable cylindrical body portion with an outer cylindrical surface for reception within and against said internal cylindrical surface and a radiating flange portion for being juxtaposed to an axial end face of said winding tube upon said reception of said cylindrical body portion, wherein the outer diameter of said cylindrical body portion corresponds to the inner diameter of said internal cylindrical surface, said body means further comprising a longitudinally extending non-expandable serration portion of conical-like configuration generally axially between said cylindrical body portion and said flange portion, wherein said serration portion comprises a plurality of longitudinally extending teeth angularly spaced about the axis of said cylindrical body portion and defining a like plurality of surface areas between said teeth, wherein said teeth start with and in said cylindrical surface of said cylindrical body portion beginning there with a zero cross-section and extend toward said flange portion with a continuously increasing geometrically similar cross-section, and wherein said plurality of surface areas between said teeth comprise continuing extensions of said cylindrical surface of said cylindrical body portion.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
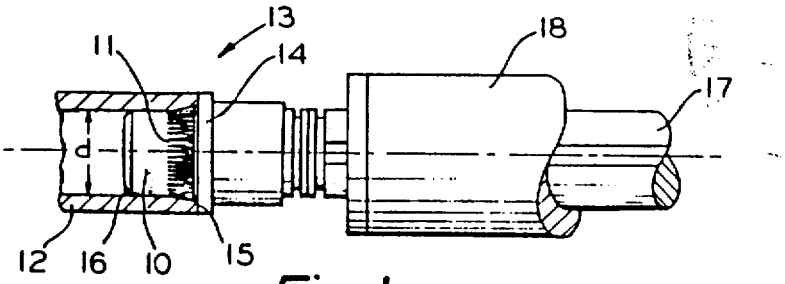
FIG. 1 is a view partly in elevation and partly broken away and in cross-section illustrating a clamping head, embodying teachings of the invention, operatively engaging an associated winding tube.

Referring now in greater detail to the drawings, FIG. 1 illustrates a winding tube 12, having an internal diameter, d, operatively engaged in a driving relationship with the clamping head 13 as by having a cylindrical body part or portion 10 thereof received in surface-to-surface contact with the inner cylindrical surface (having said diameter, d) of the winding tube 12. Further, the cyindrical body portion 10 is axially inserted into the winding tube 12 a distance sufficient to cause the flange or collar 14 to abut and bear against the juxtaposed axial end face 15 of the winding tube 12. Preferably, at its outer-most axial end, the cylindrical body portion 10 is provided with a generally circumferential bevel or chamfer 16 as to assist in the easy introduction and insertion of the cylindrical body portion 10 into and against the inner cylindrical surface of the winding tube. The clamping head 13 as shown as being rotatably mounted on associated spindle means 17 which, in turn, slides longitudinally in a spindle guideway 18. A second clamping head (not shown) is introduced in the same manner into the opposite end (not shown) of the winding tube 12.

Figure 2:
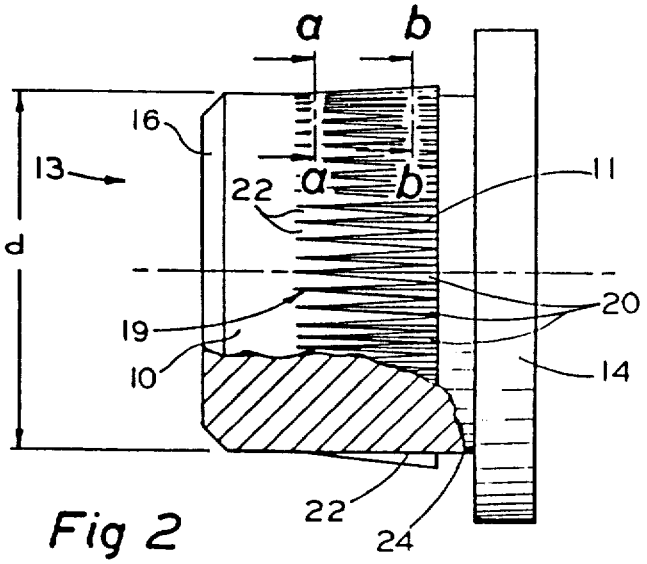
FIG. 2 is a view illustrating in enlarged scale the clamping head of FIG. 1 with a portion thereof broken away and in cross-section.

Referring also to FIG. 2, the clamping head 13, preferably formed as a unit, is not expandable and the cylindrical body portion 10 thereof has an outer diameter preferably substantially identical to the inside diameter, d, of the winding tube 12.

As illustrated in both FIGS. 1 and 2, the clamping head 13 also comprises a conical-like portion 11 which, in turn, defines a serration 19 extending axially between the cylindrical body portion 10 and the flange or collar 14. As illustrated, the serration 19 comprises a plurality of teeth 20 extending longitudinally and angularly spaced about the axis of the clamping head 13. The teeth 20 originate in the generated cylindrical outer surface of cyindrical body portion 10 and at such point of origination begin with a zero cross-section and then increase toward the collar orflange 14 with steadily increasing cross-section.

Figure 2A:
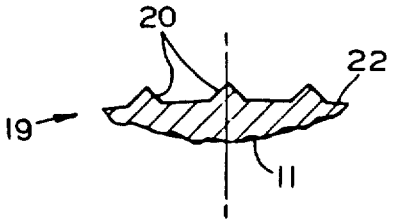
FIG. 2*a* is a fragmentary cross-sectional view taken generally on the plane of line a—a of FIG. 2 and looking in the direction of the arrows.

In all cross-sections, the teeth 20 are formed geometrically similar. For example, the fragmentary cross-sectional view of FIG. 2*a* is intended to depict that at the section plane a—a of FIG. 2 the respective apexes of teeth 20 have attained approximately one-fourth of their maximum radial extent as measured from the axis of the clamping head 13. Similarly, the fragmentary cross-sectional view of FIG. 2*b* is intended, among other things, to depict that at the section plane b—b of FIG. 2 the respective apexes of teeth 20 have attained almost their full or maximum radial extent as also measured from the axis of the clamping head 13.

Figure 2B:
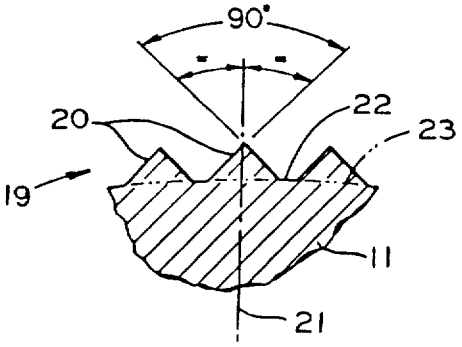
FIG. 2*b* is a fragmentary cross-sectional view taken generally on the plane of line b—b of FIG. 2 and looking in the direction of the arrows.

As best illustrated in FIG. 2*b*, the cross-section of the respective teeth 20 is formed as a triangle with an apical angle preferably in the range of 45° to 90° which, in turn, is symmetrical with respect to a radial line 21 extending through the apex of the tooth.

Preferably, a plurality of partial surface areas 22 exist between teeth 20. More specifically, respective ones of such plurality of surface areas 22 exist between successive or adjacent teeth 20. Each of such partial surface areas 22 is of a surface configuration like that of the outer cylindrical surface of cylindrical body portion 10 as to thereby be a longitudinal extension thereof.

Further, each of the plurality of partial surface areas 22 has an arcuate width related to the pitch of the teeth 20. For example, referring to FIGS. 2*a* and 2*b*, it can be seen that the width of surface areas 22 becomes wider as the cross-sectional plane of measurement more nearly approaches the cylindrical body portion 10 while the width of such surface areas 22 diminishes as the cross-sectional plane of measurement more nearly approaches the flange or collar 14. Preferably, the width of each of said plurality of surface areas 22 decreases so that at the right-most end (as viewed in FIGS. 1 or 2) of the teeth 20 the width diminishes to zero thereby, at such point, resulting in the bases, as along 23, of adjacent teeth 20 effectively abutting each other. For manufacturing reasons, an annular clearance 24 may be formed between the conical-like portion 11 and collar or flange 14.

Upon axial introduction of the clamping head 13 into the winding tube 12, the cyindrical body portion 10 together with the plurality of partial areas 22, of the conical-like portion 11, assumes and performs the important function of guiding and centering the winding tube 12 onto the clamping head 13. During the time that the clamping head 13 is thusly being inserted into winding tube 12, the teeth 20 of the serration 19 start to dig into the winding tube 12 and as the clamping head 13 progresses axially inwardly the teeth 20 also progressively further dig into the winding tube 12. Such action continues until the collar or flange 14 abuts against the juxtaposed end face 15 of the winding tube 12. Consequently, with the teeth 20 thusly dug into the winding tube 12, the winding tube 12 is made to be secure to the clamping head 13 as to positively prevent undesired relative rotation therebetween.

Further, when the clamping head 13 is to be moved out of the winding tube 12, the conical-like shape of portion 11 facilitates release of the clamping head 13 from the winding tube 12. This feature, in no small part, is due to the fact that the cross-sectional area and configuration of the teeth 20 is increasing along the longitudinal length thereof (as hereinbefore described) thereby resulting in a generally compound-angle to the side surfaces of the teeth 20 somewhat resisting the biting-in thereof into tube 12 in the radial direction while at the same time somewhat resisting the same biting-in action but in the axial direction as the clamping head 13 is being inserted into winding tube 12.

As already stated, the teeth 20 effectively bite into the tube 12 and prevent undesired relative rotation as between the winding tube 12 and clamping head 13. It should be stressed that such highly effective biting-in action by teeth 20 is, in the invention, accomplished in a uniform manner and not in the unpredictable and uneven manner of the prior art.

The interrelationship and cooperative action of the elements of the invention provide an end result not attainable by the prior art. For example, as already disclosed, the radially outer-most portions of the respective teeth 20 gradually increase in their radial extent. Consequently, as the clamping head 13 is moved axially inwardly of the winding tube 12, the teeth 20 gradually engage and bite into the tube 12 because of the general configuration of the conical-like portion 11. Further, the depth of such biting-in action by the teeth 20 is not only determined by the size of the teeth 20 but also by the continuing guiding and centering action of the piloting cylindrical body portion 10 as well as the longitudinal extensions thereof defined by the plurality of surface areas 22. That is, not only does the cylindrical body portion 10 provide a piloting and centering action with respect to tube 12, but also the plurality of surface areas 22 continue to provide such piloting and centering function even while the teeth 20 are gradually biting into the winding tube 12. It should now be apparent if there should be any tendency for the teeth 20 to bite into the winding tube 12 in any uneven manner (which would tend to cause the axis of the winding tube 12 to be displaced from the axis of the clamping head 13) the lands or surface areas 22 (between the teeth 20) which continue to pilot and center the winding tube 12 prevent any eccentric movement of the winding tube 12 with respect to the axis of the clamping head 13. As a further benefit of this, that is that the serrated conical-like portion 11 performs both a locking-driving function and a piloting or carrying function, the clamping head of the invention can be manufactured as to have a relatively short structural length, as compared to the prior art, and thereby reduce the time required for the changing of winding tubes on the associated machine.

Federal Republic of Germany patent document No. 2,222,291, even in retrospect after having been presented with the inventive teachings herein, cannot be said to suggest or even hint at the invention. The patent document No. 2,222,291 does disclose a prior art clamping head; however, such does not disclose nor suggest a clamping head having a cylindrical body portion as that at 10 of the invention. Instead, the clamping head of patent document No. 2,222,291 merely has a conical chamfer at the end thereof and than a longitudinal rib (or ribs) 3b, 4b extending for the full length of the inner body of the clamping head. Further, patent document No. 2,222,291 is devoid of any teachings relative to the cross-sectional configuration of the longitudinal rib or even the number thereof. Also, the clamping head of patent document No. 2,222,291 cannot fulfill the stringent requirements of an acceptable clamping head because the accurate centering of the winding tube is not ensured and because both the tube carrying function and tube driving function is performed solely and totally by the longitudinal rib (or ribs) which, in turn, subjects the winding tube material to undesired heavy stresses.

Switzerland Letters Patent No. 400,708 discloses what may be referred to as a core pin which is introduced into the winding tube at its open end so as to avoid deformation of the winding tube during such times as when it is being handled. In the FIG. 1 embodiment the core pin is provided with a series of saw-tooth or barb-like projections which engage the winding tube and resist withdrawal of the core pin. Somewhat similarly in the embodiment of FIG. 3, a few longitudinal circumferentially distributed ribs ascend, starting at the inner most end of the core pin, toward the end collar thereof. Such saw-tooth or continuous ribs, in and of themselves, even in retrospect, do not suggest or even hint at a clamping head forming the invention disclosed herein.

Although only the preferred embodiment of the invention has been disclosed and described, it is apparent that other embodiments and modifications of the invention are possible within the scope of the appended claims.

What is claimed is:

1. A clamping head for centering and clamping a winding tube onto or from which web type material such as a paper web and the like is being wound or unwound and wherein said winding tube comprises an internal axially extending cylindrical surface, comprising a clamping head body means, said body means comprising a non-expandable cylindrical body portion with an outer cylindrical surface for reception within and against said internal cylindrical surface and a radiating flange portion for being juxtaposed to an axial end face of said winding tube upon said reception of said cylindrical body portion, wherein the outer diameter of said cylindrical body portion corresponds to the inner diameter of said internal cylindrical surface, said body means further comprising a longitudinally extending non-expandable serration portion of conical-like configuration generally axially between said cylindrical body portion and said flange portion, wherein said serration portion comprises a plurality of longitudinally extending teeth angularly spaced about the axis of said cylindrical body portion and defining a like plurality of surface areas between said teeth, wherein said teeth start with and in said cylindrical surface of said cylindrical body portion beginning there with a zero cross-section and extend toward said flange portion with a continuously increasing geometrically similar cross-section, wherein said plurality of surface areas between said teeth comprise continuing extensions of said cylindrical surface of said cylindrical body portion, and wherein in the region of said flange portion said teeth abut against each other at their respective bases in circumferential direction about the axis of said cylindrical body portion.

2. A clamping head according to claim 1 wherein the cross-section of each of said teeth as viewed in a plane normal to the axis of said cylindrical body portion is formed as a triangle with an apical angle of 45° to 90° symmetrical about a radial line passing through the apex of such respective teeth.

3. A clamping head according to claim 1 wherein said plurality of teeth are equally angularly spaced about the axis of said cylindrical body portion.

4. A clamping head according to claim 1 wherein said plurality of teeth are equally angularly spaced about the axis of said cylindrical body portion, and wherein the cross-section of each of said teeth as viewed in a plane normal to the axis of said cylindrical body portion is formed as a triangle with an apical angle of 45° to 90° symmetrical about a radial line passing through the apex of such respective teeth.

5. A clamping head for centering and clamping a winding tube onto or from which web type material such as a paper web and the like is being wound or unwound and wherein said winding tube comprises an internal axially extending cylindrical surface, comprising a generally axially extending clamping head body means, said body means comprising first second and third axially aligned body portions arranged in sequence, said first body portion comprising a non-expandable axially extending cylindrical body portion with an outer cylindrical surface for piloting reception within and against said internal cylindrical surface of said winding tube, said second body portion comprising an axially extending non-expandable serration portion of conical-like configuration, said third body portion comprising a radiating flange portion, wherein said second body portion is situated axially between said third body portion and said first body portion as to thereby have said cylindrical body portion extend axially furthermost from said flange portion, wherein said outer cylindrical surface s of an axial length sufficient to pilotingly engage and physically support said winding tube without said winding tube having to engage said serration portion, wherein said flange portion is effective for operatively abutting against an axial end face of said winding tube when said winding tube is fully in operative engagement with both said outer cylindrical surface and said serration portion, wherein said serration portion comprises a plurality of longitudinally extending teeth angularly spaced about the axis of said cylindrical body portion and defining a like plurality of surface areas between said teeth, wherein said teeth start with and in said outer cylindrical surface of said cylindrical body portion beginning there with a zero cross-section and extend toward said flange portion with a continuously increasing geometrically similar cross-section, wherein said plurality of surface area between said teeth comprise continuing extensions of said outer cylindrical surface of said cylindrical body portion, and wherein in the region of said flange portion said teeth abut against each other at their respective bases in circumferential direction about the axis of said cylindrical body portion.

6. A clamping head according to claim 5 wherein the cross-section of each of said teeth as viewed in a plane normal to the axis of said cylindrical body portion is formed as a triangle with an apical angle of 45° to 90° symmetrical about a radial line passing through the apex of such respective teeth.

7. A clamping head according to claim 5 wherein said plurality of teeth are equally angularly spaced about the axis of said cylindrical body portion.

8. A clamping head according to claim 5 wherein said plurality of teeth are equally angularly spaced about the axis of said cylindrical body portion, and wherein the cross-section of each of said teeth as viewed in a plane normal to the axis of said cylindrical body portion is formed as a triangle with an apical angle of 45° to 90° symmetrical about a radial line passing through the apex of such respective teeth.

* * * * *

UNITED STATES PATENT AND TRADEMARK OFFICE

CERTIFICATE OF CORRECTION

PATENT NO. : 4,793,567

DATED : December 27, 1988

INVENTOR(S) : HANS WEISS et al

It is certified that error appears in the above-identified patent and that said Letters Patent is hereby corrected as shown below:

The title page should be deleted to appear as per attached title page.

Figures 1, 2, 2a and 2b should be deleted to be replaced with figures 1, 2, 2a and 2b as shown on the attached sheet.

Signed and Sealed this

Eighth Day of August, 1989

*Attest:*

DONALD J. QUIGG

*Attesting Officer*

*Commissioner of Patents and Trademarks*

United States Patent [19]

Weiss et al.

[11] Patent Number: 4,793,567

[45] Date of Patent: Dec. 27, 1988

[54] CLAMPING HEAD FOR CENTERING AND CLAMPING WINDING TUBES

[75] Inventors: Hans Weiss; Hans-Joachim Fissmann; Hans-Albrecht Ruff, all of Heidenheim, Fed. Rep. of Germany

[73] Assignee: J. M. Voith GmbH, Heidenheim, Fed. Rep. of Germany

[21] Appl. No.: 108,228

[22] Filed: Oct. 14, 1987

[30] Foreign Application Priority Data

Oct. 25, 1986 [DE] Fed. Rep. of Germany ..... 3636457

[51] Int. Cl.[4] ..... B65H 18/04; B65H 16/06

[52] U.S. Cl. ..... 242/68.1; 242/68.4

[58] Field of Search ..... 242/68.1–68.6, 242/129.51

[56] References Cited

U.S. PATENT DOCUMENTS

| | | | |
|---|---|---|---|
| 2,928,619 | 3/1960 | Burton et al. | 242/68.1 |
| 3,955,770 | 5/1976 | Offermann | 242/68.4 |

FOREIGN PATENT DOCUMENTS

| | | |
|---|---|---|
| 1676507 | 5/1954 | Fed. Rep. of Germany . |
| 1574438 | 7/1970 | Fed. Rep. of Germany . |
| 2222291 | 11/1973 | Fed. Rep. of Germany . |
| 2832361 | 1/1980 | Fed. Rep. of Germany . |
| 3243994 | 5/1984 | Fed. Rep. of Germany . |
| 377854 | 7/1964 | Switzerland . |
| 400708 | 4/1966 | Switzerland . |
| 888860 | 2/1962 | United Kingdom . |

*Primary Examiner*—Stuart S. Levy
*Assistant Examiner*—Steven M. duBois
*Attorney, Agent, or Firm*—Lon H. Romanski

[57] ABSTRACT

A clamping head is shown having a cylindrical portion engaging an interior portion of an associated winding tube and a collar or flange which axially abuts against the axial end face of the associated winding tube; extending axially between the cylindrical portion and the collar or flange is a conical portion of longitudinally extending serration; the teeth of such serration start, from the diameter of the cylindrical portion, beginning with a zero cross-section and increase toward the collar or flange with steadily increasing geometrically similar cross-section.

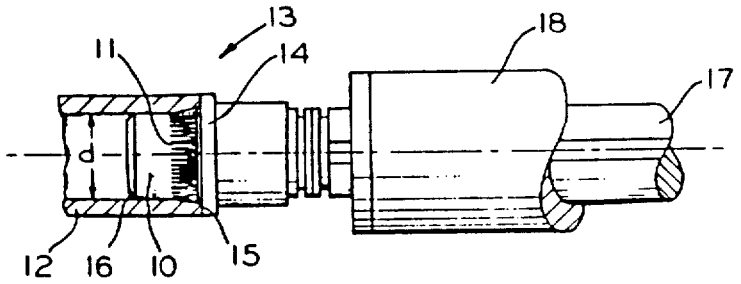

8 Claims, 1 Drawing Sheet